US008610524B2

(12) United States Patent
Yen et al.

(10) Patent No.: US 8,610,524 B2
(45) Date of Patent: Dec. 17, 2013

(54) TRANSFORMER

(75) Inventors: Chun-Ching Yen, Taoyuan Hsien (TW); Yu-Jen Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/456,689

(22) Filed: Apr. 26, 2012

(65) Prior Publication Data

US 2013/0015933 A1 Jan. 17, 2013

(30) Foreign Application Priority Data

Jul. 15, 2011 (TW) ..... 100125025 A

(51) Int. Cl.
*H01F 27/06* (2006.01)
*H01F 27/29* (2006.01)
*H01F 27/30* (2006.01)

(52) U.S. Cl.
USPC ..... 336/65; 336/68; 336/192; 336/196; 336/198

(58) Field of Classification Search
USPC ..... 336/192, 196, 198, 199, 65, 68
See application file for complete search history.

(56) References Cited

U.S. PATENT DOCUMENTS

| | | | | | |
|---|---|---|---|---|---|
| 2,869,089 | A | * | 1/1959 | Hampel | 336/192 |
| 2,889,524 | A | * | 6/1959 | Schmitz | 336/192 |
| 3,217,278 | A | * | 11/1965 | Beckes et al. | 336/192 |
| 3,504,319 | A | * | 3/1970 | Leonard | 336/68 |
| 4,234,865 | A | * | 11/1980 | Shigehara | 336/92 |
| 4,937,546 | A | * | 6/1990 | Horng | 336/65 |
| 4,967,121 | A | * | 10/1990 | Nero | 315/411 |
| 5,684,446 | A | * | 11/1997 | Adkins et al. | 336/92 |

* cited by examiner

*Primary Examiner* — Alexander Talpalatski
*Assistant Examiner* — Joselito Baisa
(74) *Attorney, Agent, or Firm* — Muncy, Geissler, Olds & Lowe, PLLC

(57) ABSTRACT

A transformer includes a base, a magnetic core unit and a winding assembly. The base includes a base body and a pin disposed on the base body. The magnetic core unit is disposed in the base body, and the winding assembly is disposed in the magnetic core unit. A winding of the winding assembly is connected to the pin.

20 Claims, 9 Drawing Sheets

TRANSFORMER

CROSS-REFERENCE TO RELATED APPLICATIONS

This Application claims priority of Taiwan Patent Application No. 100125025, filed on Jul. 15, 2011, the entirety of which is incorporated by reference herein.

BACKGROUND OF THE INVENTION

1. Field of the Invention

The invention relates to a transformer, and in particular to a transformer having a base.

2. Description of the Related Art

A transformer is a magnetic component usually used in electrical equipment. The voltage of the transformer may be adjusted to adapt to the electrical equipment according to the electromagnetic induction principle.

Please refer to FIG. 1, which is a perspective view of a transformer 1 of the prior art. The transformer 1 includes a winding stand 110, a plurality of windings 120, and a magnetic core 130. The windings 120 are wound on the winding stand 110. The conductive ends 121 of windings 120 are connected to the pins 112 on the base plate 111 of winding stand 110. The magnetic core 130 covers the winding stand 110 and the winding 120. The insulating tape 140 is located between the winding 120 and the magnetic core 130 and covers the winding 120. In FIG. 1, the distance between two adjacent pins 112 are very close, and the base plate 111 does not have any wire management. Thus, determining the corresponding connections between the conductive ends 121 and the pins 112 are very difficult, and the conductive ends 121 may be connected with each other by mistake.

Moreover, to satisfy the Safety regulation, the magnetic core 130 should be covered by a plurality of layers of the insulating tapes 150. However, winding the insulating tapes 150 to the magnetic core 130 is time-consuming, and thus the production efficiency of the transformer 1 will be decrease. Further, since the material of the insulating tape 150 is not solid, the transformer 1 may be damaged during transportation.

BRIEF SUMMARY OF THE INVENTION

To solve the problems of the prior art, the object of the invention is provide a transformer including a base covering the magnetic core unit to decrease the time of covering the magnetic core unit. Moreover, the transformer has a retaining groove. The conductive ends of the winding are received in the retaining groove to prevent the conductive ends thereof from contacting with each other.

For the above objective, a transformer includes a base, a magnetic core unit, and a winding assembly. The base includes a base body and a pin. The base body has a containing space and a retaining groove. The pin is disposed on the base body. The magnetic core unit is disposed in the containing space, and has a receiving groove. The winding assembly includes a winding stand and a winding. The winding stand is disposed in the receiving groove. The winding is disposed on the winding stand. The winding has a first conductive end. The first conductive end is received in the retaining groove and connected to the pin.

For the above objective, a transformer includes a base, a magnetic core unit, and a winding assembly. The base includes a base body having a containing space. The magnetic core unit is disposed in the containing space, and has a receiving groove. The winding assembly includes a winding stand, a pin, and a winding. The winding stand is disposed in the receiving groove, and has a retaining portion. The retaining portion passes through the base body to the outside of the base body. The pin is disposed in the retaining portion. The winding is wound to the winding stand, and has a first conductive end. The first conductive end is received in the retaining groove and connected to the pin.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
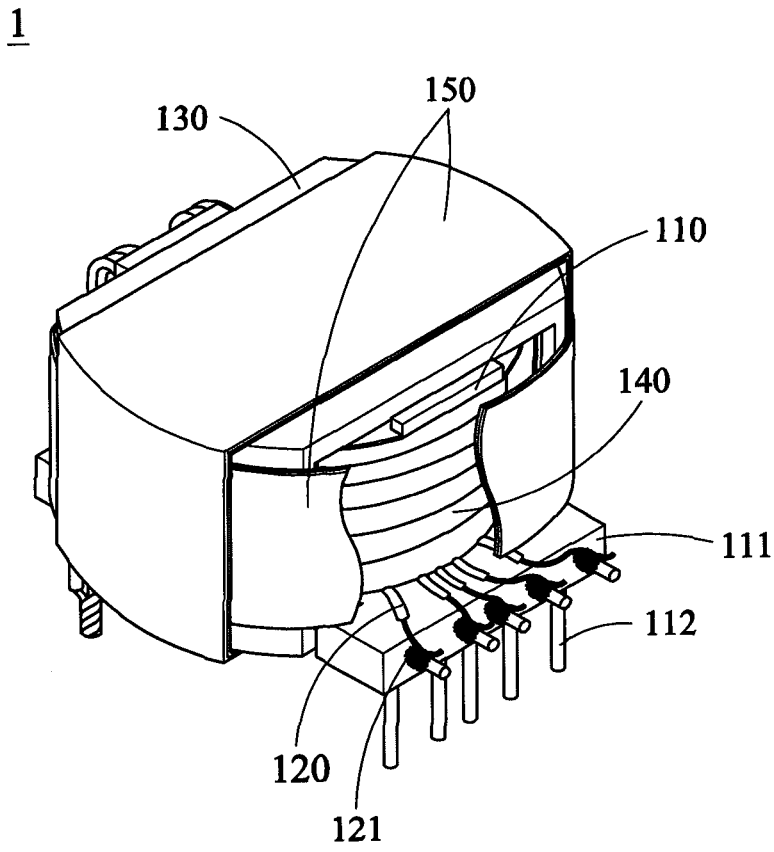
FIG. 1 is a perspective view of a transformer of the prior art.
Figure 2:
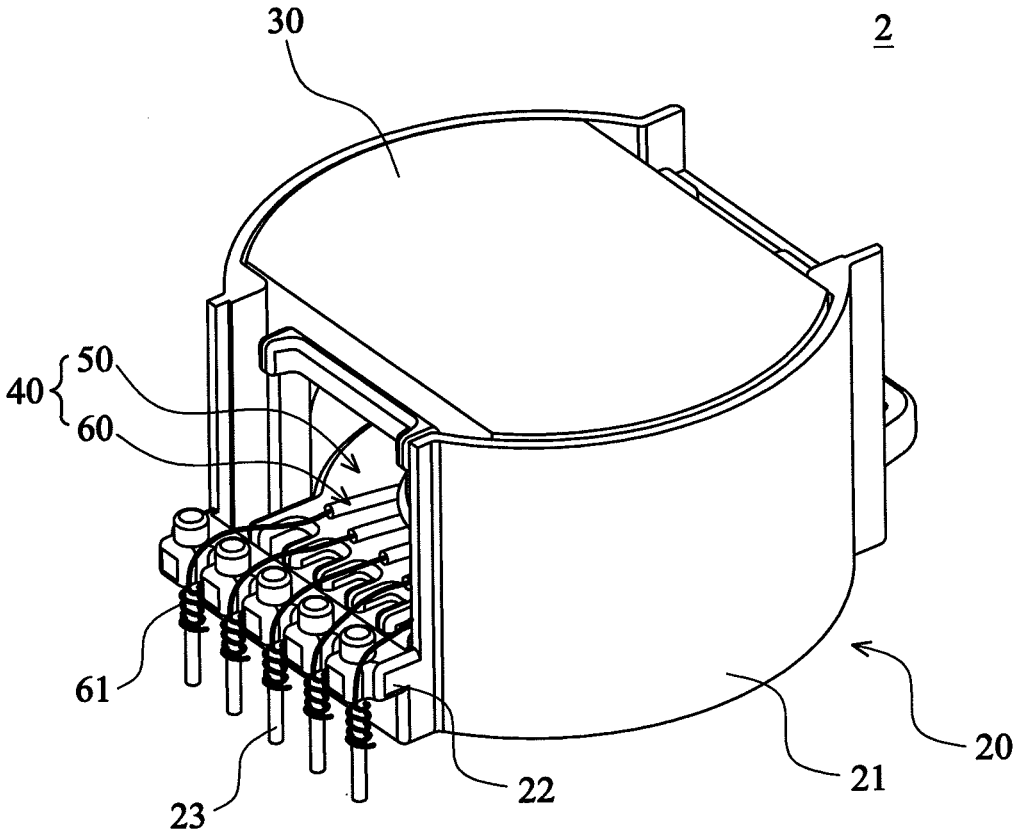
FIG. 2 is a perspective view of a first embodiment of a transformer of the invention.
Figure 3:
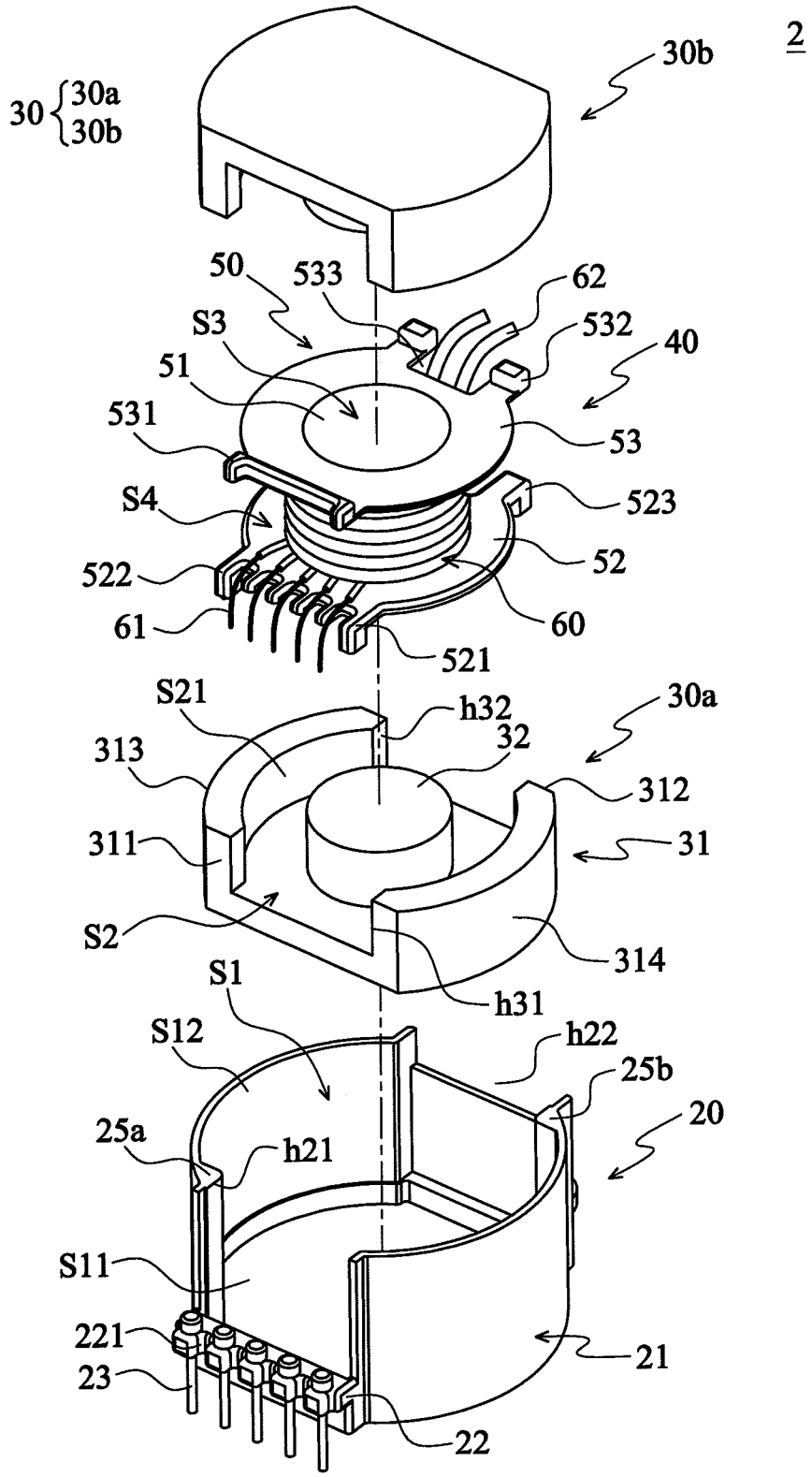
FIGS. 3 and 4 are exploded views of the first embodiment of the transformer of the invention.
Figure 4:
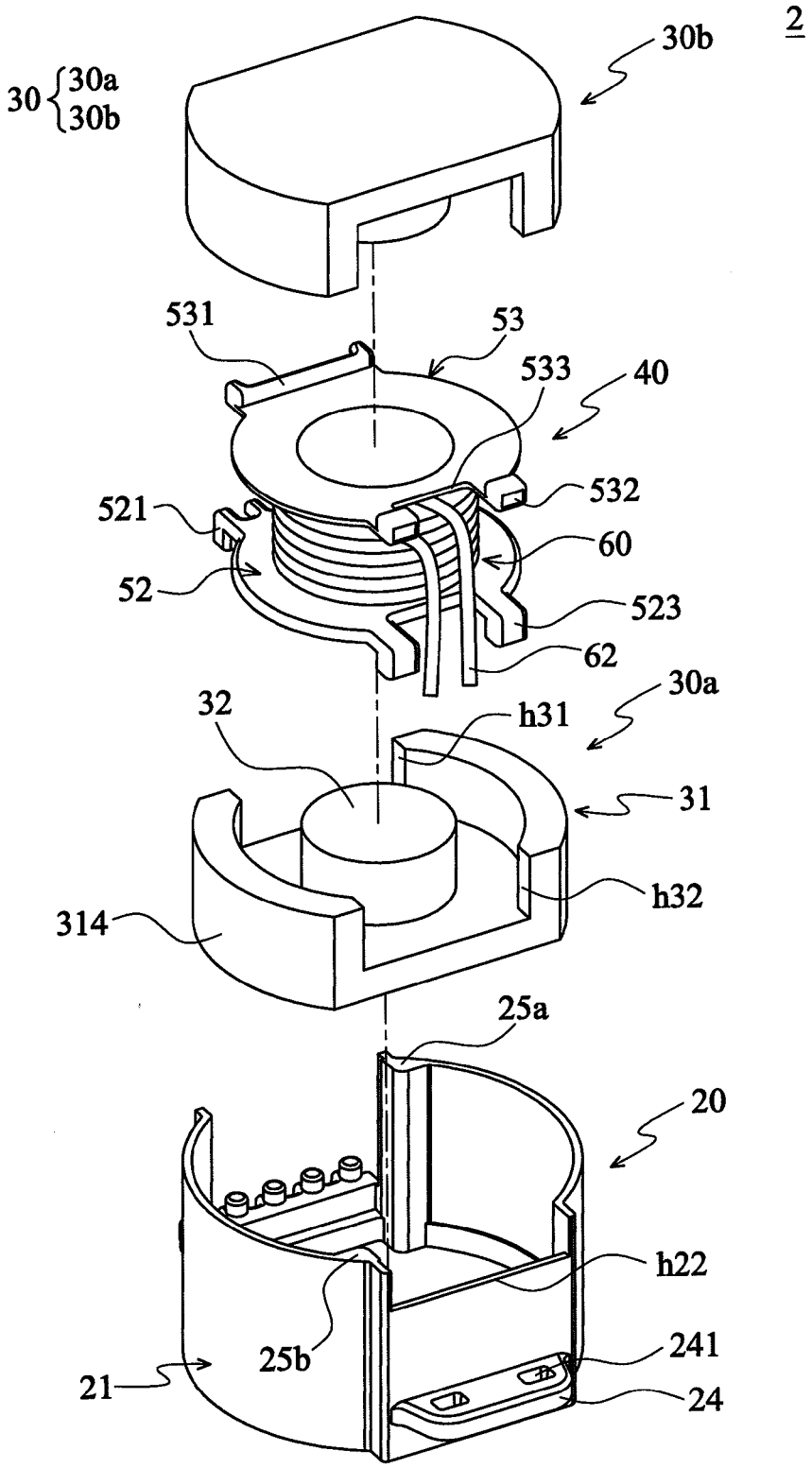

Please refer to FIG. 2 to FIG. 4. FIG. 2 is a perspective view of a first embodiment of a transformer 2 of the invention, and FIGS. 3 and 4 are exploded views of the first embodiment of the transformer 2 of the invention. The transformer 2 includes a base 20, a magnetic core unit 30, and a winding assembly 40.

The base 20 substantially is a hollow columella. The base 20 is made of rigid insulated material, such as rigid plastic, and thus the base 20 is hard to damage compared to the insulating tape of the prior art. The base 20 includes a base body 21, a retaining portion 22, a plurality of pins 23, and a holding unit 24. The base body 21 has a first opening h21, a second opening h22 and a containing space S1. The first opening h21 is opposite to the second opening h22. The first opening h21 and the second opening h22 are communicated with the containing space S1. The retaining portion 22 is disposed on the base body 21 and close to the first opening h21. The pins 23 are disposed on the base body 21 via the retaining portion 22. The pins 23 are parallel arranged and separately near to the first opening h21. The retaining portion 22 has a plurality of retaining grooves 221. Each of the retaining grooves 221 is located between two adjacent pins 23. The holding unit 24 is disposed on the base body 21 and close to the second opening h22. The holding unit 24 has a plurality of holding holes 241.

The base 20 further includes a first positioning pole 25*a* and a second positioning pole 25*b* disposed on the side wall S12. The first positioning pole 25*a* and the second positioning pole 25*b* are extended from the bottom S11 to the top of the containing space S1, and are respectively disposed in diagonal corners of the containing space S1. Moreover, the first positioning pole 25*a* is close to the first opening h21, and the second positioning pole 25*b* is close to the second opening h22. Since the structure of the base 20 close to the first opening h21 and the second opening h22 is enhanced by the first positioning pole 25*a* and the second positioning pole 25*b*, the base 20 may protect the transformer 2 from damage.

The magnetic core unit 30 is assembled by a first magnetic core 30*a* and a second magnetic core 30*b*. The magnetic core unit 30 is rotatably disposed in the containing space S1. The magnetic core unit 30 includes a magnetic core body 31 and a magnetic core column 32. The magnetic core column 32 is disposed in the center of the magnetic core body 31, and a ring-shaped receiving groove S2 is formed between the magnetic core body 31 and the magnetic core column 32.

The magnetic core body 31 comprises a first side 311, a second side 312, a first arc surface 313, and a second arc surface 314. The first side 311 is opposite to the second side 312, and the first arc surface 313 is opposite to the second arc surface 314. The first side 311 has a first magnetic core opening h31, and the second side 312 has a second magnetic core opening h32. The first magnetic core opening h31, the second magnetic core opening h32, and the receiving groove S2 are communicated with each other. The curvatures of the first arc surface 313 and the second arc surface 314 correspond to the curvatures of the side wall S12.

The winding assembly 40 includes a winding stand 50 and a plurality of windings 60. The winding stand 50 is disposed in the receiving groove S2. The winding 60 is wound to the winding stand 50. As shown in FIG. 2, the base 20 of the embodiment covers the magnetic core unit 30 and the winding assembly 40, and thus the base 20 may protect the transformer 2 from damage. Each of the windings 60 has a first conductive end 61 and a second conductive end 62. The winding stand 50 includes a winding body 51, a first baffle 52, and a second baffle 53. The winding body 51 may be a hollow columella. The winding body 51 has a receiving hole S3 at the center thereof. When the winding assembly 40 is disposed in the receiving groove S2 of the magnetic core unit 30, the magnetic core column 32 is received in the receiving hole S3. The first baffle 52 and the second baffle 53 are disposed on two opposite sides of the winding body 51. A winding groove S4 is formed between the first baffle 52, the second baffle 53, and the winding body 51. The winding 60 is wound in the winding groove S4.

The first baffle 52 includes a wire management portion 521 and a first blocking portion 523. The wire management portion 521 is extended into the first magnetic core opening h31 and the first opening h21, and the first blocking portion 523 is extended into the second magnetic core opening h32 and the second opening h22. The wire management portion 521 has a plurality of wire management grooves 522. The wire management grooves 522 correspond to the retaining grooves 221. When the winding assembly 40 is not assembled to the magnetic core unit 30, the first conductive ends 61 of the winding 60 are held in the wire management grooves 522. Thus, the first conductive ends 61 are arranged in order by the wire management grooves 522. Next, when the winding assembly 40 is installed into the magnetic core unit 30, the first conductive ends 61 are held in the retaining groove 221 easily, since the wire management grooves 522 correspond to the retaining grooves. Thus, the wire management grooves 522 and the retaining grooves 221 could be used for managing the first conductive ends 61. Also, since the retaining grooves 221 are separated with each other, the first conductive ends 61 may not be contacted with each other by mistake.

The second baffle 53 includes a second blocking portion 531 and a third blocking portion 532. The second blocking portion 531 is extended into the first magnetic core opening h31 and the first opening h21. The third blocking portion 532 is extended into the second magnetic core opening h32 and the second opening h22. The first blocking portion 523, the second blocking portion 531, and the third blocking portion 532 are U-shaped structures. The third blocking portion 532 has a through hole 533. The rotation of the winding stand 50 corresponding to the magnetic core unit 30 and the base 20 is limited or prevented by the first blocking portion 523, the second blocking portion 531, and the third blocking portion 532. Moreover, when the winding 60 is disposed on the winding assembly 40, the first blocking portion 523, the second blocking portion 531, and the third blocking portion 532 are used for assisting the winding 60 to wind on the winding groove S4.

In FIG. 4, the second conductive ends 62 of the winding 60 passes through the through hole 533 and are retained in the third blocking portion 532. Thus, the third blocking portion 532 could be used for managing the second conductive ends 62. When the base 20, the magnetic core unit 30, and the winding assembly 40 are assembled sequentially, the second conductive ends 62 pass through the second magnetic core opening h32, the second opening h22, and the holding hole 241 of the holding unit 24, and is held on the holding unit 24.

Figure 5:
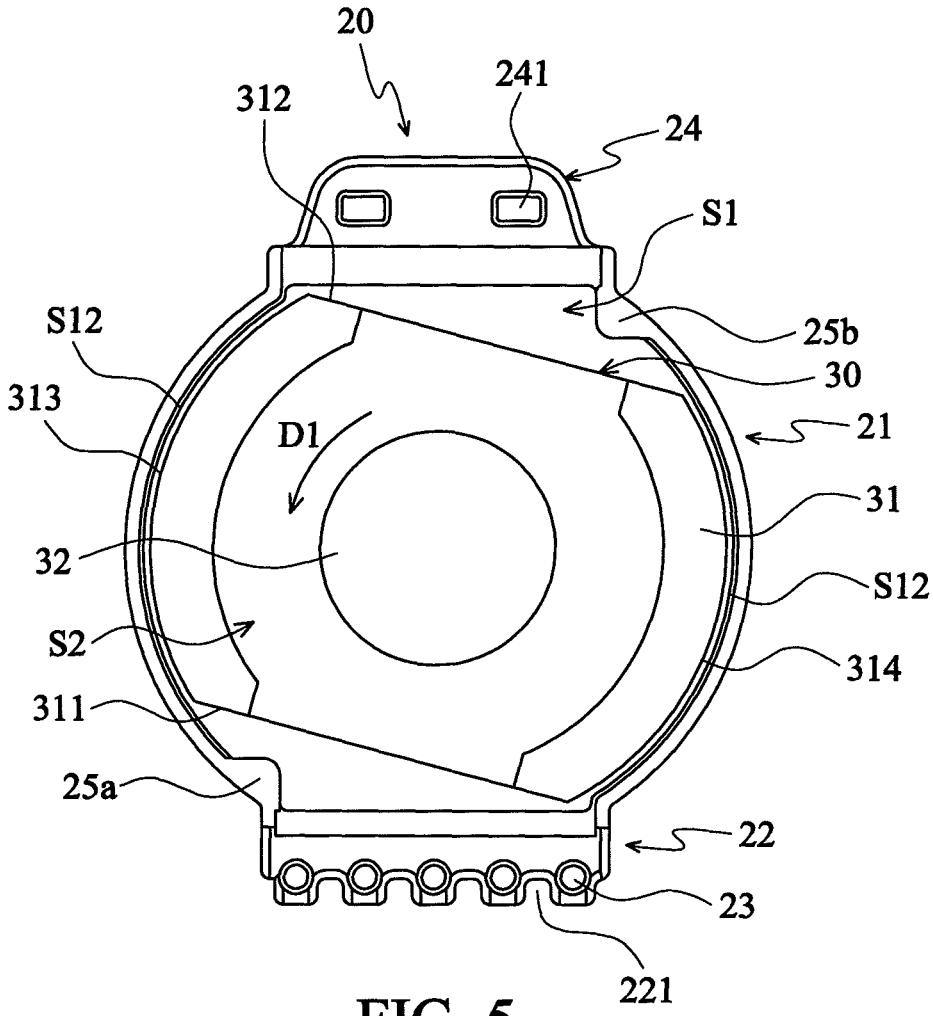
FIGS. 5 and 6 are top views of a magnetic core unit and a base of the first embodiment.
Figure 6:
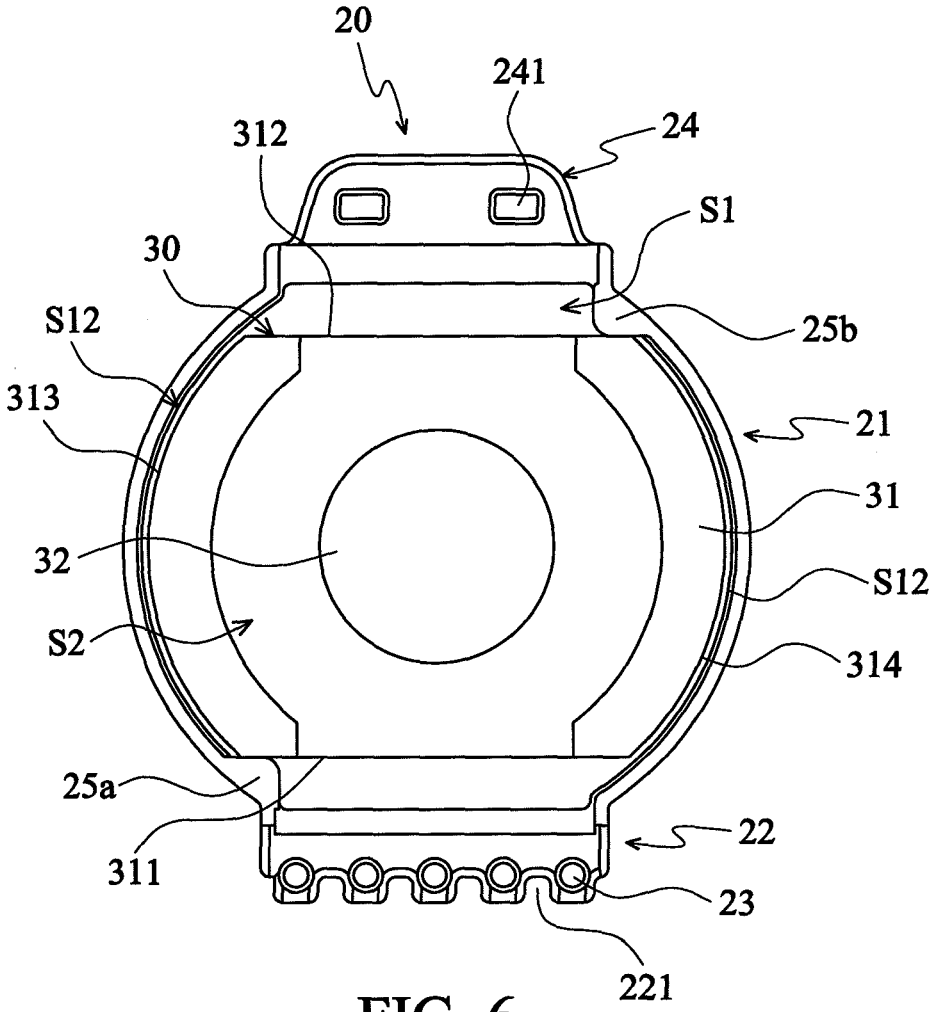

Please refer to FIGS. 5 and 6, which are a schematic view of the magnetic core unit 30 and the base 20 of the first embodiment. In the embodiment, the magnetic core unit 30 does not need to be aligned with the base 20 accurately. In FIG. 5, the magnetic core unit 30 is approximately put into the containing space S1 of the base 20, and thus the time of the alignment between the magnetic core unit 30 and the base 20 is decreased. Moreover, since the side wall S12 is a curved surface corresponding to the first arc surface 313 and the second arc surface 314 of the magnetic core unit 30, the magnetic core unit 30 is rotatable relative to the base 20.

In the embodiment, the base 20 has a first positioning pole 25*a* and a second positioning pole 25*b*. The first positioning pole 25*a* and the second positioning pole 25*b* are located at the diagonal corners of the containing space S1 and are close to the edges of the first side 311 and the second side 312 of the magnetic core unit 30, respectively. When the magnetic core unit 30 is rotated along a rotation direction D1 at a location in FIG. 5, the first positioning pole 25*a* blocks the first side 311 and the second positioning pole 25*b* blocks the second side 312. Therefore, the rotation of the magnetic core unit 30 is blocked by the first positioning pole 25*a* and the second positioning pole 25*b*.

Please refer to FIG. 6, after the magnetic core unit 30 is approximately put into the containing space S1 of the base 20, the first side 311 may contact the first positioning pole 25*a* and the second side 312 may contact the second positioning pole 25*b* by rotating the magnetic core unit 30. Thus, the magnetic core unit 30 could be adjusted to a predetermine location at the base 20. By the assembly of the transformer 2 of the embodiment, the time of assembling the magnetic core unit 30 to the base 20 can be decreased, and the magnetic core unit 30 could be assembled at the base accurately.

Figure 7:
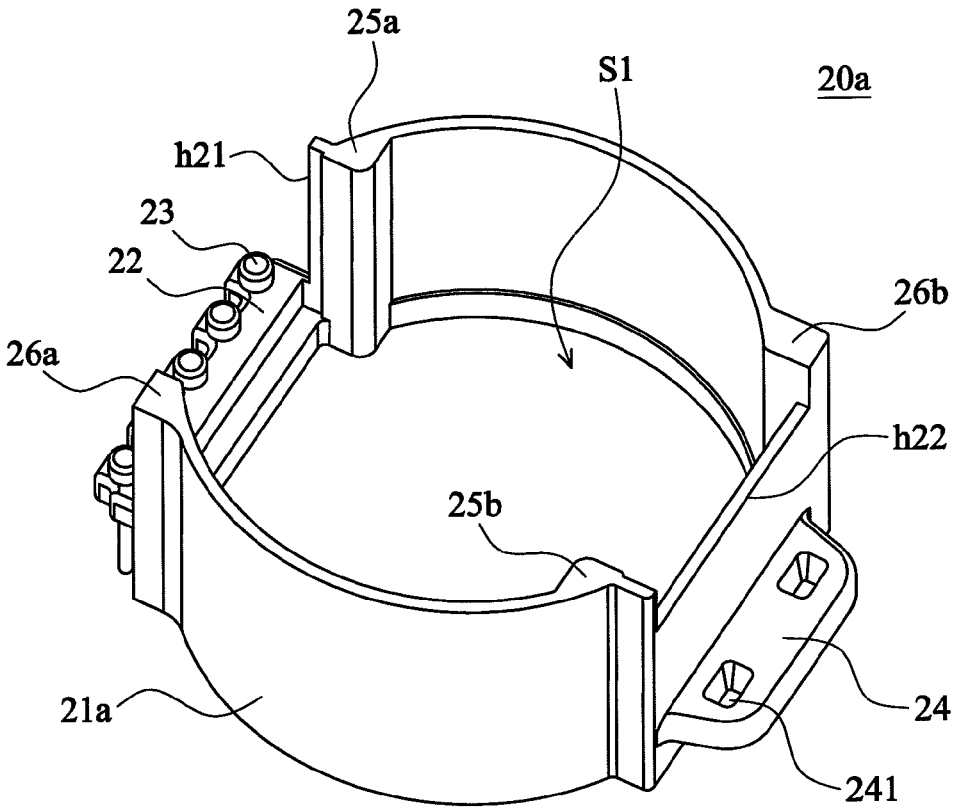
FIG. 7 is a perspective view of a second embodiment of a base of the invention.

Please refer to FIG. 7, which is a perspective view of a second embodiment of a base 20*a* of the invention. The differences between the second embodiment and the first embodiment are described as following. The base 20*a* includes a reinforcing rib 26*a* and a sub-reinforcing rib 26*b*. The reinforcing rib 26*a* is extended from the base body 21 and close to the first opening h21. The sub-reinforcing rib 26*b* is extended from the base body 21 and close to the second opening h22. The structure of the base 20 near the first opening h21 and the second opening h22 can be enhanced by the reinforcing rib 26*a* and the sub-reinforcing rib 26*b* of the embodiment. Thus, the base 20 could be further protected from the damage.

Figure 8:
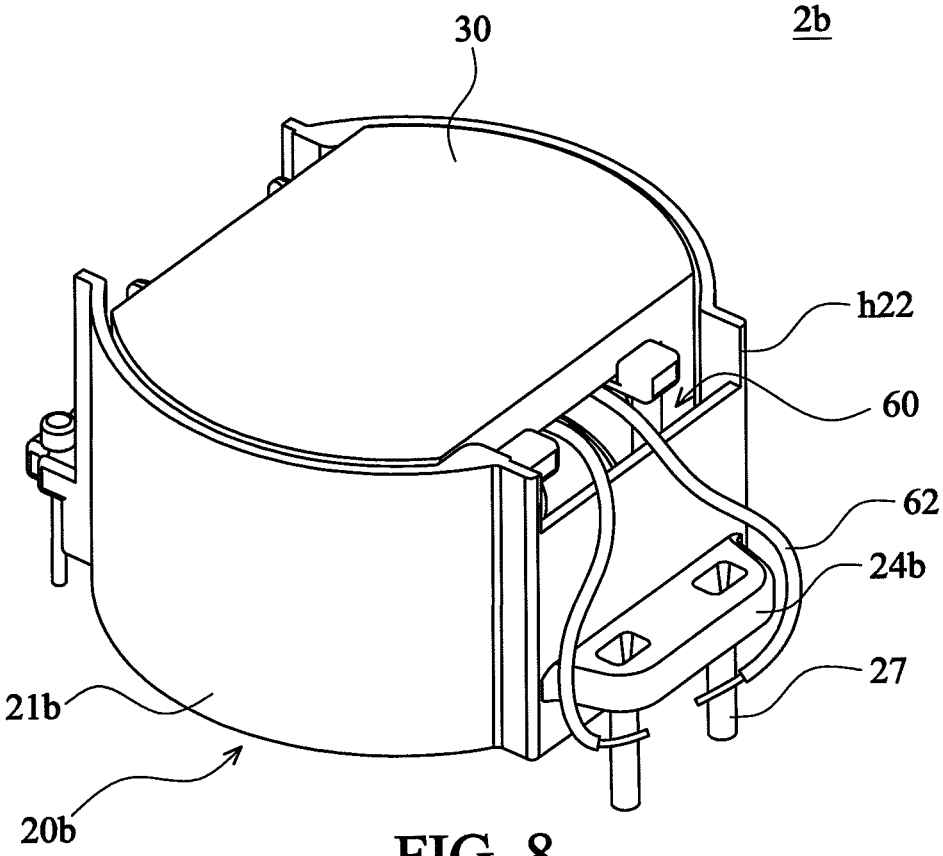
FIG. 8 is a perspective view of a third embodiment of a transformer of the invention.

Please refer to FIG. 8, which is a perspective view of a third embodiment of a transformer 2*b* of the invention. The differences between the third embodiment and the first embodiment are described as following. The base 20*b* further includes a sub-pin 27. The holding unit 24 of the first embodiment is replaced by an extending portion 24*b*. The extending portion 24*b* is extended from the base body 21*b*. The sub-pin 27 is disposed on a base body 21*b* via the extending portion 24*b*. The second conductive ends 62 of the winding 60 are connected to the sub-pins 27, respectively.

Figure 9:
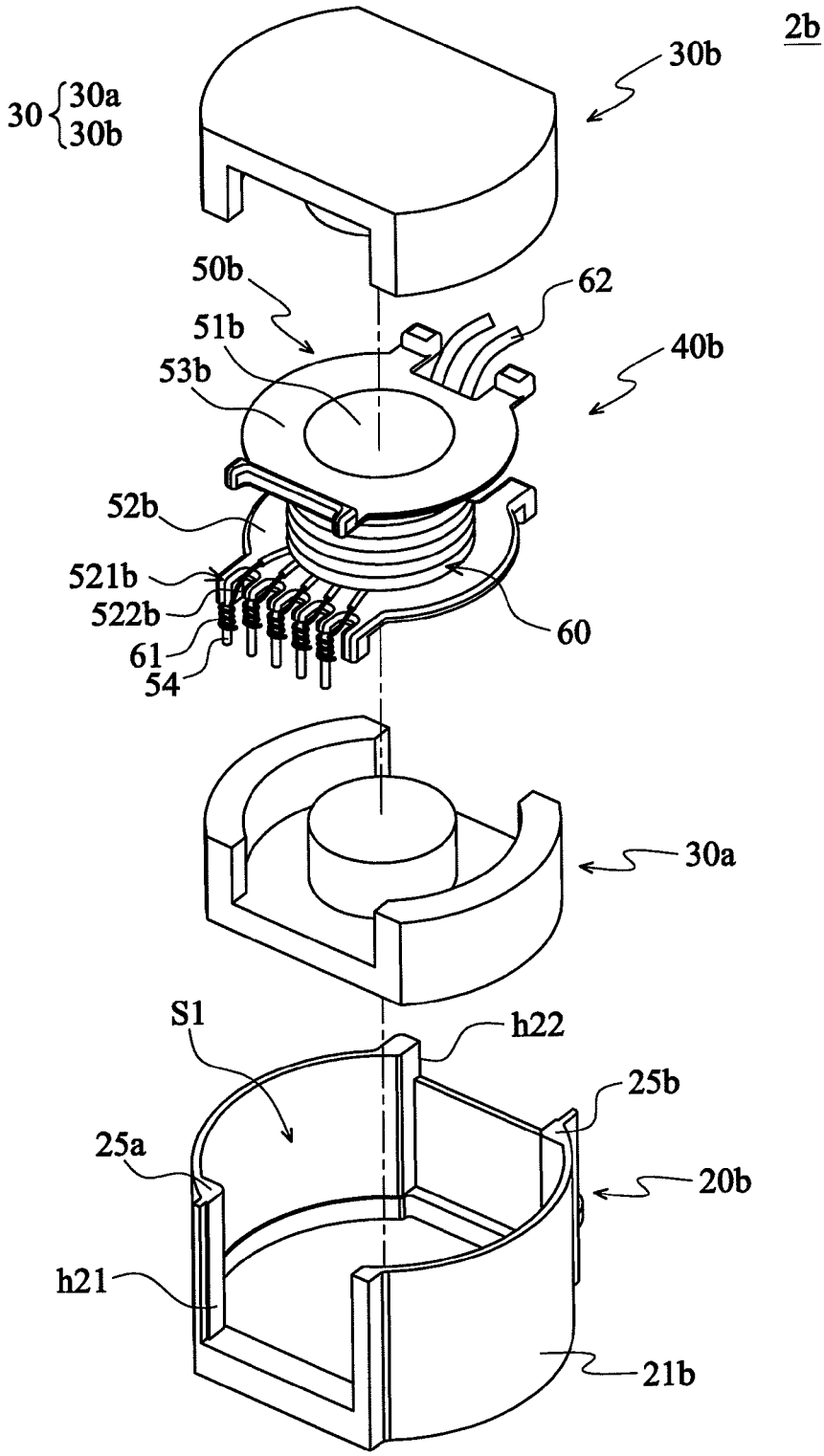
FIG. 9 is an exploded view of the third embodiment of a transformer of the invention.

Please refer to FIG. 9, which is an explored view of the third embodiment of a transformer 2*b* of the invention. In the third embodiment, the retaining portion 22 and the pin 23 of the first embodiment are not disposed on the base body 21*b*. The winding stand 50*b* includes a plurality of pins 54, and the first baffle 52*b* includes a retaining portion 521*b*. The retaining portion 521*b* passes through the first magnetic core opening h31 of the magnetic core unit 30 and the first opening h21 of the base body 21 to the outside of the base body 21*b*. The pins 54 are disposed on the retaining portion 521*b*. The pins 54 are located at the outside of the base body 21 and are separately parallel with each other.

The retaining portion 521*b* has a plurality of retaining grooves 522*b*. The retaining grooves 522*b* are located between two adjacent pins 23. The first conductive ends 61 of the winding 60 passes through the first magnetic core opening h31 and the first opening h21 to the outside of the base body 21*b*. The first conductive ends 61 are retained to the retaining groove 522*b* and connected to the pins 54. By the above structure, the first conductive ends 61 can be connected to the pins 54 before the winding assembly 40*b* is assembled. Thus, the first conductive ends 61 can be prevented from connecting to the pins 54 when the winding assembly 40*b* is assembled to the base 20*b*.

In conclusion, the first conductive ends of the winding are managed by the structure the retaining grooves and the wire management grooves. Thus, the misconnections between the conductive ends can be prevented. Moreover, since the base is made of rigid insulated material, the insulating tape of the prior art can be replaced by the base, and the magnetic core unit, and the winding assembly can be assembled to the base easily. Thus, the production efficient of the transformer is increased. Further, the base is hard to damage, and the base may protect the transformer 2 from damage.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A transformer, comprising:

a base comprising:

a base body having a containing space; and a pin disposed on the base body;

a magnetic core unit, disposed in the containing space, having a receiving groove; and a winding assembly comprising:

a winding stand disposed in the receiving groove; and a winding, disposed on the winding stand, having a first conductive end connected to the pin, wherein the base comprises a first positioning pole and a second positioning pole respectively disposed in diagonal corners of the containing space, wherein the magnetic core unit is rotatably disposed in the continuing space, and the magnetic core unit has a first side and a second side opposite to the first side, wherein when the magnetic core unit is rotated along a rotation direction, the first side contacts the first positioning pole, and the second side contacts the second positioning pole.

2. The transformer as claimed in claim 1, wherein the base body has a first opening communicated with the containing space, and the pin is close to the first opening.

3. The transformer as claimed in claim 2, wherein the base comprises a reinforcing rib extended from the base body and close to the first opening.

4. The transformer as claimed in claim 1, wherein the base includes a sub-pin, and the winding has a second conductive end, the sub-pin is disposed on the base body, and the second conductive end is connected to the sub-pin.

5. The transformer as claimed in claim 4, wherein the base body has a second opening communicated with the containing space and close to the sub-pin, and the second conductive end passes through the second opening.

6. The transformer as claimed in claim 5, wherein the base includes a sub-reinforcing rib extended from the base body and close to the second opening.

7. The transformer as claimed in claim 1, wherein the base includes a holding unit, and the winding has a second conductive end, the holding unit is disposed on the base body, and the second conductive end passes through the holding unit.

8. The transformer as claimed in claim 7, wherein the base body has a second opening communicated with the containing space and close to the holding unit, and the second conductive end passes through the second opening.

9. The transformer as claimed in claim 8, wherein the base includes a sub-reinforcing rib extended from the base body and close to the second opening.

10. The transformer as claimed in claim 9, wherein the base body has a retaining groove, and the first conductive end is received in the retaining groove.

11. A transformer, comprising:

a base comprising:

a base body having a containing space;

a magnetic core unit, disposed in the containing space, having a receiving groove; and a winding assembly comprising:

a winding stand disposed in the receiving groove, wherein the winding stand comprises a retaining portion passing through the base body;

a pin disposed on the retaining portion; and a winding, disposed on winding stand, having a first conductive end connected to the pin, wherein the base includes a first positioning pole and a second positioning pole respectively disposed in diagonal corners of the containing space, wherein the magnetic core unit is rotatablv disposed in the containing space, and the magnetic core unit has a first side and a second side opposite to the first side, wherein when the magnetic core unit is rotated along a rotation direction, the first side contacts the first positioning pole, and the second side contacts the second positioning pole.

12. The transformer as claimed in claim 11, wherein the base body has a first opening communicated with the containing space, and the retaining portion passes through the first opening.

13. The transformer as claimed in claim 12, wherein the base includes a reinforcing rib extended from the base body and close to the first opening.

14. The transformer as claimed in claim 11, wherein the base includes a sub-pin, the winding has a second conductive end, the sub-pin is disposed on the base body, and the second conductive end is connected to the sub-pin.

15. The transformer as claimed in claim 14, wherein the base body has a second opening communicated with the containing space and close to the sub-pin, and the second conductive end passes through the second opening.

16. The transformer as claimed in claim 15, wherein the base includes a sub-reinforcing rib extended from the base body and close to the second opening.

17. The transformer as claimed in claim 11, wherein the base includes a holding unit, and the winding has a second conductive end, wherein the holding unit is disposed on the base body, and the second conductive end passes through the holding unit.

18. The transformer as claimed in claim 17, wherein the base body has a second opening communicated with the containing space and close to the holding unit, and the second conductive end passes through the second opening.

19. The transformer as claimed in claim 18, wherein the base includes a sub-reinforcing rib extended from the base body and close to the second opening.

20. The transformer as claimed in claim 11, wherein the retaining portion has a retaining groove, and the first conductive end is received in the retaining groove.

* * * * *